US008590523B2

(12) United States Patent
O'Malley

(10) Patent No.: US 8,590,523 B2
(45) Date of Patent: Nov. 26, 2013

(54) MACHINE FOR TRUING ABRASIVE WHEELS

(75) Inventor: Keith L. O'Malley, Lake Hopatcong, NJ (US)

(73) Assignee: 3M Innovative Properties Company, St. Paul, MN (US)

( * ) Notice: Subject to any disclaimer, the term of this patent is extended or adjusted under 35 U.S.C. 154(b) by 423 days.

(21) Appl. No.: 12/993,234

(22) PCT Filed: Aug. 13, 2009

(86) PCT No.: PCT/US2009/053717

§ 371 (c)(1), (2), (4) Date: Nov. 17, 2010

(87) PCT Pub. No.: WO2010/019774

PCT Pub. Date: Feb. 18, 2010

(65) Prior Publication Data

US 2011/0067683 A1 Mar. 24, 2011

(51) Int. Cl.
*B24B 53/00* (2006.01)

(52) U.S. Cl.
USPC ..... 125/11.03; 451/72

(58) Field of Classification Search
USPC ..... 451/56, 6, 5, 72, 443, 444; 125/11.01, 125/11.03
See application file for complete search history.

(56) References Cited

U.S. PATENT DOCUMENTS

| | | | | |
|---|---|---|---|---|
| 2,539,941 | A | 1/1951 | Allen | |
| 2,614,368 | A * | 10/1952 | Polk et al. | 451/6 |
| 3,067,733 | A | 12/1962 | Pernack | |
| 3,075,513 | A | 1/1963 | Seidel | |
| 3,242,918 | A | 3/1966 | Striepe | |
| 3,411,492 | A | 11/1968 | Merritt | |
| 3,581,730 | A | 6/1971 | Boyd | |
| 3,894,358 | A | 7/1975 | Lorenz | |
| 4,026,073 | A | 5/1977 | Betzler | |
| 4,051,830 | A | 10/1977 | Gruber | |
| 4,198,950 | A | 4/1980 | Van DeMotter | |
| 4,406,275 | A | 9/1983 | Janutta | |
| 4,522,188 | A | 6/1985 | Houghton | |
| 4,590,573 | A | 5/1986 | Hahn | |
| 5,363,598 | A | 11/1994 | Imai | |
| 6,869,342 | B2 | 3/2005 | Stollberg | |
| 8,216,025 | B2 * | 7/2012 | Hirose et al. | 451/11 |

FOREIGN PATENT DOCUMENTS

| | | |
|---|---|---|
| DE | 31 12 084 | 3/1982 |
| DE | 43 16 583 | 11/1994 |
| EP | 0 356 663 | 3/1990 |
| GB | 344624 | 3/1931 |
| GB | 498356 | 1/1939 |
| GB | 514 048 | 10/1939 |

(Continued)

*Primary Examiner* — Robert Rose
(74) *Attorney, Agent, or Firm* — Scott A. Baum

(57) ABSTRACT

A truing and dressing machine for profiling an abrasive wheel. The truing and dressing machine includes a truing wheel assembly for positioning the truing wheel relative to an abrasive wheel mounted on an abrasive wheel spindle. The truing wheel assembly includes a truing wheel swivel located between a truing wheel spindle housing and a reciprocation slide that is attached to an infeed slide. An infeed slide swivel is located between the infeed slide and a bottom support swivel plate which is rotatably connected to a base plate. Utilization of both an infeed slide swivel and a truing wheel swivel allows for dressing both sides and the face of the abrasive wheel without having to remove, flip, and reinsert the abrasive wheel into the machine.

19 Claims, 6 Drawing Sheets

(56) References Cited

FOREIGN PATENT DOCUMENTS

| | | |
|---|---|---|
| GB | 596099 | 12/1947 |
| GB | 601617 | 5/1948 |
| GB | 618072 | 2/1949 |
| GB | 637862 | 5/1950 |
| GB | 782677 | 9/1957 |
| GB | 1 269 828 | 4/1972 |
| GB | 1 305 968 | 2/1973 |
| GB | 1 324 350 | 7/1973 |
| GB | 1 367 488 | 9/1974 |
| JP | 55-150969 | 11/1980 |
| JP | 2000-135675 | 5/2000 |
| KR | 10-0819823 | 4/2008 |
| WO | WO 2005/080046 | 9/2005 |

* cited by examiner

MACHINE FOR TRUING ABRASIVE WHEELS

BACKGROUND

Truing and dressing machines are used to reshape and profile abrasive wheels that are used by machine tools to produce various machined parts such as gears, end mills, and drill bits. Truing and dressing machines have a rotating spindle to drive the abrasive wheel in need of dressing and a rotating spindle to drive a truing wheel. The truing wheel is typically supported for pivoting about a primary pivot or swivel that rotates the truing wheel about the face of the abrasive wheel in need of dressing to create the abrasive wheel profile.

Often, it is necessary to dress one or both sides of the abrasive wheel, in addition to the face, to obtain the desired profile on the abrasive wheel. Side dressing both sides of the abrasive wheel can be especially difficult for an abrasive wheel pack having two or more abrasive wheels spaced axially along a shaft. Frequently, it is necessary to remove the abrasive wheel pack from the abrasive wheel spindle and reinsert the abrasive wheel pack rotated 180 degrees into the dressing and truing machine a second time to profile the other side of the abrasive wheels that where inaccessible during the first dressing operation. Therefore, what is needed is a truing and dressing machine that can conveniently profile both sides of an abrasive wheel; especially, when that abrasive wheel is part of an abrasive wheel pack.

SUMMARY

It has now been discovered that improved clearance for a truing wheel can be obtained by designing a dressing and truing machine having three pivots or swivels located between the truing wheel and the base plate of the machine. The three pivots, working in combination, allow for both sides and the face of an abrasive wheel to be readily dressed by the truing wheel without having to remove and reinsert the abrasive wheel into the truing and dressing machine.

Hence, in one aspect, the invention comprises a truing and dressing machine having a base plate having an X axis and a Y axis passing through a primary pivot; an abrasive wheel spindle supported for rotation in an abrasive wheel spindle housing, the abrasive wheel spindle housing attached to the base plate, and the abrasive wheel spindle operably connected to an abrasive wheel drive for rotation; a truing wheel assembly rotatably connected to the base plate for rotation about the primary pivot located in the base plate; the truing wheel assembly including a bottom support swivel plate, an infeed slide swivel attached to the bottom support swivel plate, an infeed slide attached to the infeed slide swivel, a reciprocation slide attached to the infeed slide swivel, a truing wheel swivel attached to the infeed slide, a truing wheel spindle housing attached to the truing wheel swivel, a truing wheel spindle supported for rotation in the truing wheel spindle housing, and the truing wheel spindle operably connected to a truing wheel drive for rotation.

DESCRIPTION OF THE DRAWINGS

It is to be understood by one of ordinary skill in the art that the present discussion is a description of exemplary embodiments only, and is not intended as limiting the broader aspects of the present invention, which broader aspects are embodied in the exemplary construction.

Figure 1:
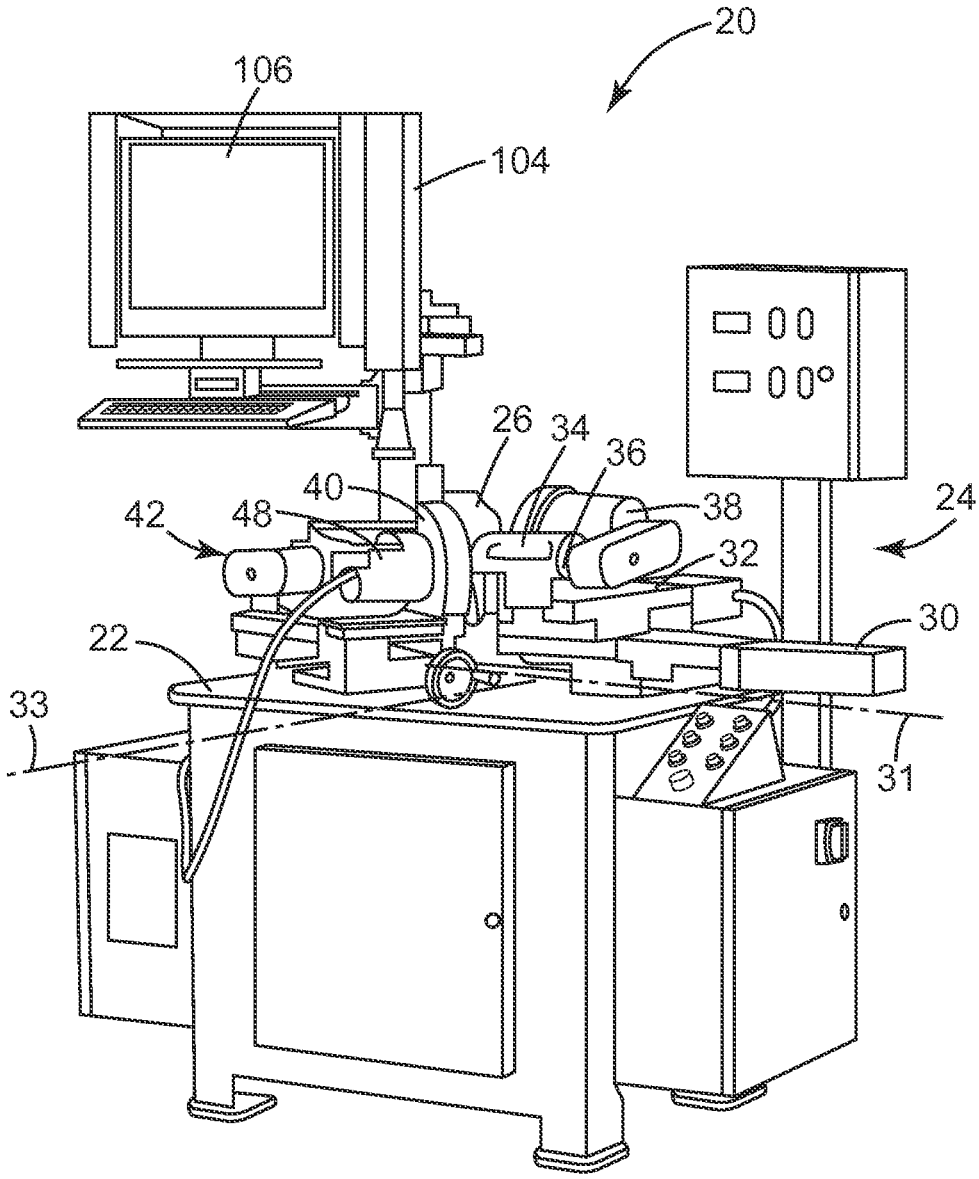
FIG. 1 is a perspective view of one embodiment of a truing and dressing machine.
Figure 2:
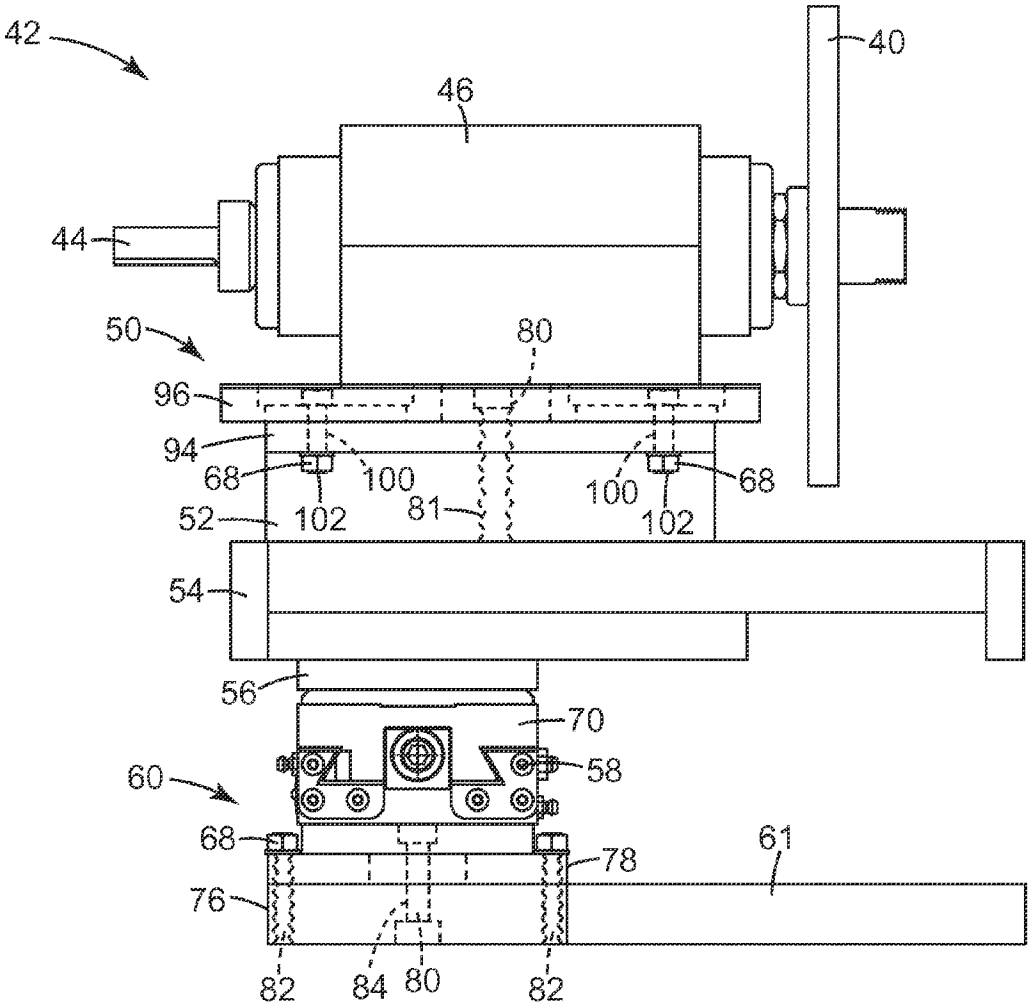
FIG. 2 is a front view of a truing wheel assembly of the machine of FIG. 1.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein "attached" means that two members can be directly connected to each other such that their surfaces are adjacent or touching, or attached means that the two members are indirectly connected to each other by the use of one or more intermediate members present between the attached members. For example, when a housing is attached to a base plate, the housing can be directly connected to the base plate by suitable fasteners or the housing can be connected to a spacer block by suitable fasteners and the spacer block can then be connected to the base plate by suitable fasteners.

DETAILED DESCRIPTION

Figure 3A:
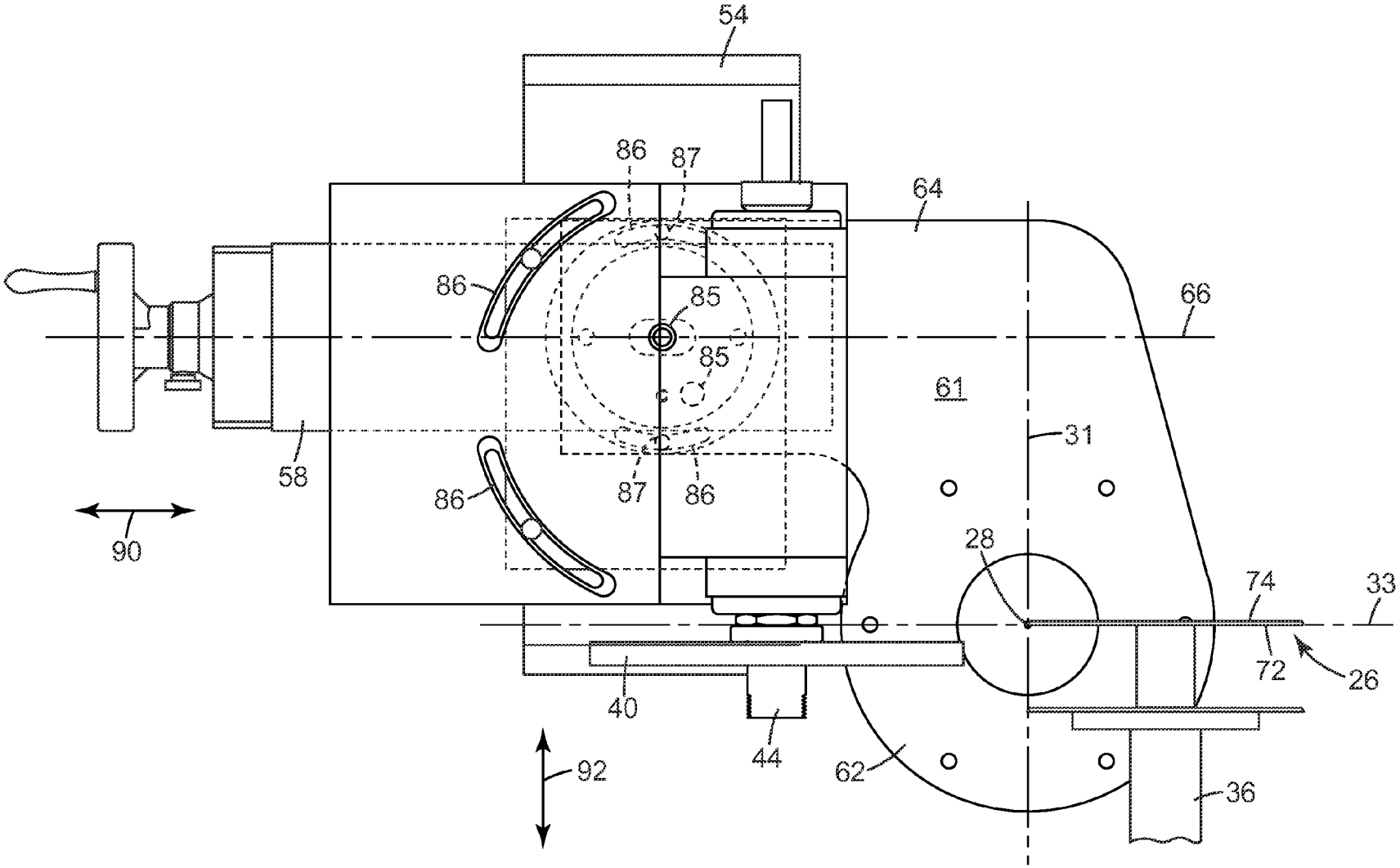
FIGS. 3A-3C are top views of the truing wheel assembly shown in various angular orientations used when dressing an abrasive wheel pack.
Figure 3B:
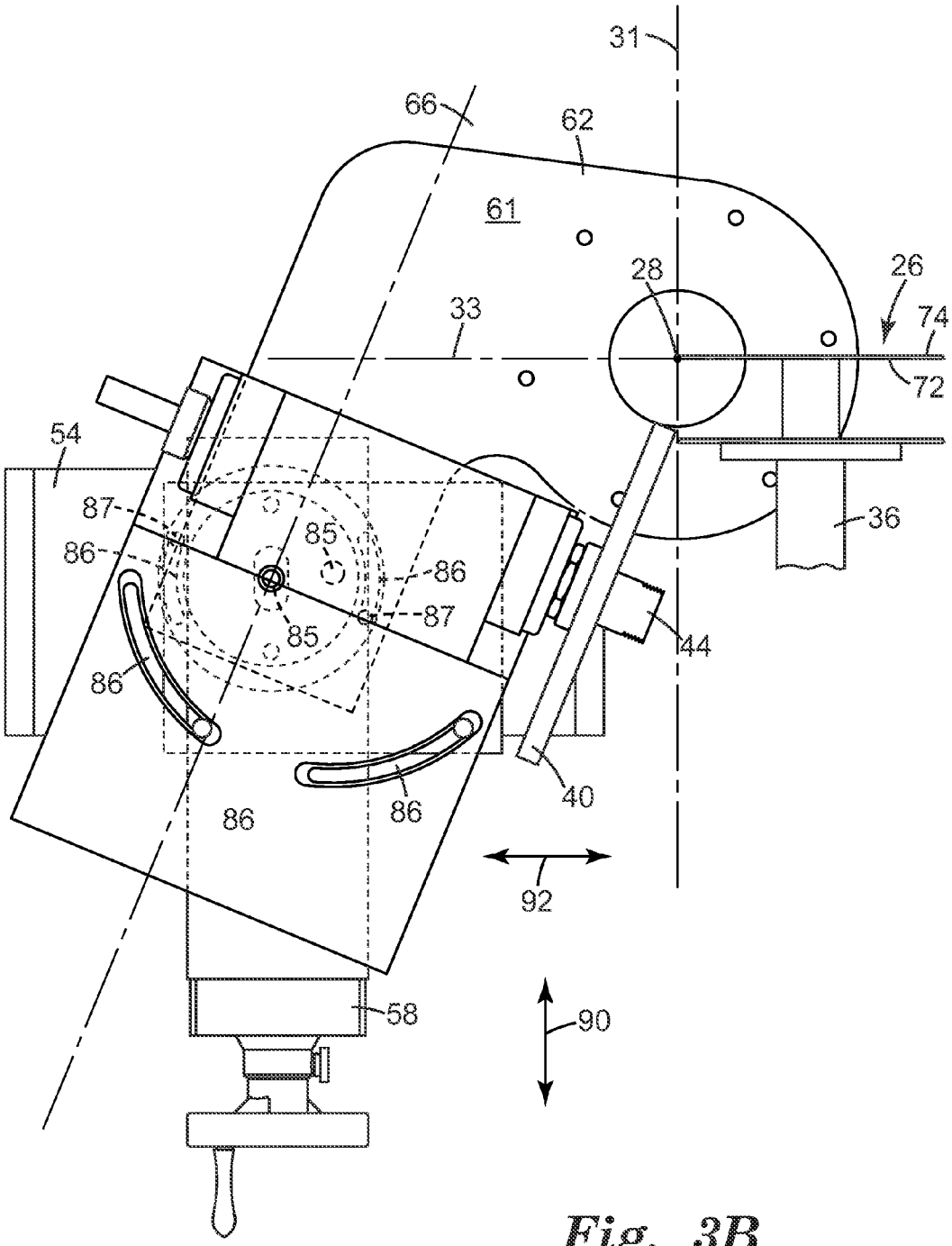
Figure 3C:
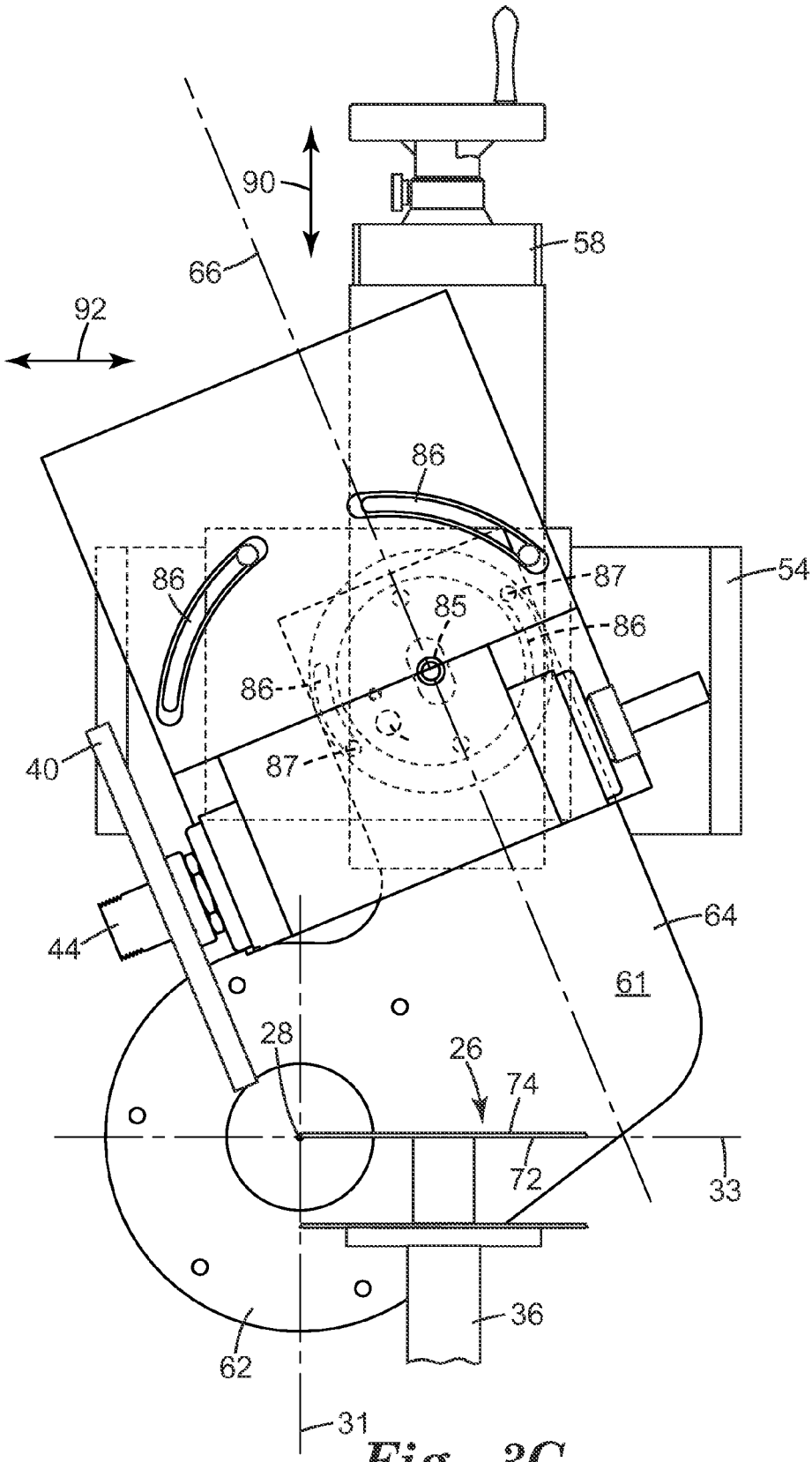

Referring to FIG. 1, a truing and dressing machine 20 is illustrated. The truing and dressing machine 20 includes a base plate 22. Attached to the base plate 22 is an X-Y compound slide 24 for positioning an abrasive wheel 26 relative to a primary pivot 28 or swivel (FIGS. 3A-3C). The X-Y compound slide 24 includes a first slide 30 for moving the abrasive wheel 26 along the machine axis or an X axis 31 and a second slide 32 for moving the abrasive wheel 26 in the cross machine direction or along a Y axis 33. The X axis 31 and the Y axis 33 are orthogonal to each other. The X-Y compound slide 24 can be manually operated using hand wheels or the X-Y compound slide 24 can be operated using motorized linear slides with digital readouts to accurately position the abrasive wheel 26 relative to the primary pivot 28 for dressing.

In one embodiment, a compound X-Y slide part number D88224 manufactured by SKF Motion Technologies, Bethlehem, Pa. was used. The X-Y compound slide 24 provided 9 inches (229 mm) of travel and in both the X and Y directions. In other embodiments of the truing and dressing machine 20, the machine can include the first slide 30 without using the second slide 32, the second slide 32 without using the first slide 30, or the abrasive wheel 26 can be attached to the base plate 22 in a fixed position. Using an X-Y compound slide 24 is more convenient than adjusting the position of the abrasive wheel 26 using spacer blocks or manual methods to obtain the correct position relative to the primary pivot 28.

Attached to the second slide 32 is an abrasive wheel spindle housing 34 which supports an abrasive wheel spindle 36. The abrasive wheel spindle 36 is supported for rotation by the use of bearings or journals within the abrasive wheel spindle housing 34. The abrasive wheel spindle 36 is driven by an abrasive wheel drive 38 such as a motor attached to the second slide 32 that transfers power via a timing belt and a first toothed pulley attached to the motor shaft and a second toothed pulley attached to the abrasive wheel spindle 36.

The abrasive wheel spindle 36 can be provided with various ends to mount the abrasive wheel 26 or an abrasive wheel pack having two abrasive wheels as shown in FIGS. 3A-3C. For example, a HSK50 or CAT40 style spindle end can be provided. If necessary, various adaptors known to those of skill in the art can be used to mount the abrasive wheel 26 to the HSK50 or CAT40 style spindle end.

In order to dress the abrasive wheel 26, a truing wheel 40 and a truing wheel assembly 42 are provided. The truing wheel assembly 42 pivots or swivels about the primary pivot 28 located in the base plate 22. This allows the truing wheel assembly 42 to dress a radius on the face of the abrasive wheel 26 and to position the truing wheel 40 for dressing either side of the abrasive wheel 26. Sufficient rotational movement is provided by the primary pivot 28 to grind the desired profiles or surfaces on the abrasive wheel 26. Typically, the truing wheel assembly 42 can pivot greater than about 150 degrees, or greater than about 200 degrees about the primary pivot 28. In one embodiment, the primary pivot 28 allowed the truing wheel assembly 42 to swivel approximately ±105 degrees relative to the Y axis 33 or approximately 210 degrees about the primary pivot 28.

Referring to FIG. 2 and FIGS. 3A-3C, the truing wheel assembly 42 includes a truing wheel spindle 44, a truing wheel spindle housing 46, a truing wheel drive 48 (FIG. 1), a truing wheel swivel 50, a truing wheel riser block 52, a reciprocation slide 54, a reciprocation slide riser block 56 (optional), an infeed slide 58, an infeed slide swivel 60, and a bottom support swivel plate 61.

In one embodiment, the bottom support swivel plate 61 includes a circular portion 62 surrounding the primary pivot 28 and an offset arm 64 extending from the circular portion 62. The offset arm 64 extends parallel to the Y axis 33 when the bottom support swivel plate 61 is locked to an angular position of 0 degrees relative to the Y axis 33 (FIG. 3A). A longitudinal axis 66 of the offset arm 64 extends parallel to the Y axis 33 in this position.

Figure 4:
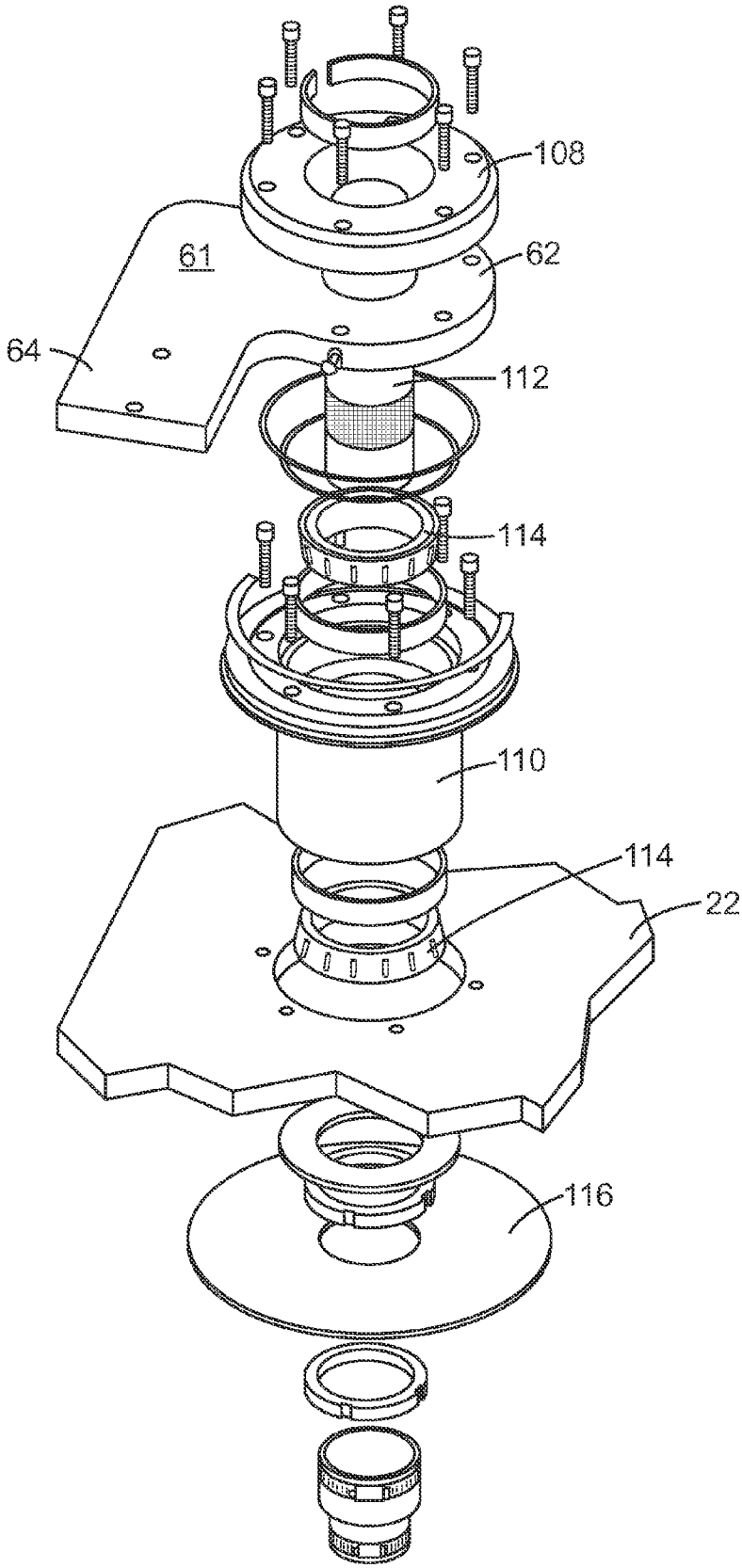
FIG. 4 is a perspective view of a rotatable connection.

Referring to FIG. 4, the bottom support swivel plate 61 is rotatably connected to the base plate 22 such that the circular portion 62 of the bottom support swivel plate 61 pivots about the primary pivot 28. In one embodiment, the rotating connection includes a flanged hub 108, a flanged housing 110, and a hollow shaft 112 supported for rotation in the flanged housing 110. The flange of the flanged hub 108 is bolted to the circular portion 62 and the flange of the flanged housing 110 is bolted to the base plate 22. The center bore of the flanged hub 108 is attached to the hollow shaft 112 that is supported for rotation in the flanged housing 110 by a pair of opposed tapered roller bearings 114. A brake rotor 116 is attached to the opposite end of the hollow shaft 112 beneath the base plate 22. The bottom support swivel plate 61 can be locked into a desired angular position by a brake shoe actuated against the brake rotor 116. If desired, the hollow shaft 112 can be connected to a source of vacuum to remove grinding dust during dressing of the abrasive wheel 26. Alternative methods of rotatably connecting the bottom support swivel plate 61 to the base plate 22 can be utilized if desired.

The infeed slide 58 is attached to the offset arm 64 by the infeed slide swivel 60. The infeed slide swivel 60 is designed to allow the infeed slide 58 to rotate ±22.5 degrees relative to the longitudinal axis 66. Suitable swivels can include a cylindrical rod in a support structure, a sphere that rotates within a support structure, a cylindrical rod supported within a hollow rod, or two plates that rotate relative to each other.

In one embodiment, the infeed slide swivel 60 comprised a first plate 76 and a second plate 78, which rotate relative to each other. The first plate 76 comprised the distal end of the offset arm 64 and the first plate 76 includes a pivot hole 80 and two threaded stop holes 82 located 180 degrees apart on opposite sides of the pivot hole 80. The second plate 78 includes a center pivot hole 84 and two circular slots 86 located 180 degrees apart on opposite sides of the center pivot hole 84. The second plate 78 is bolted to the bottom of the infeed slide 58. Two index pins 87 having both ends threaded are screwed into the two threaded stop holes 82 in the first plate 76. A pivot pin 85, such as a shoulder bolt, having one threaded end is used to attach the first plate 76 to the second plate 78. The bottom support swivel plate 61 and the infeed slide 58 are assembled by passing the two index pins 87 of the first plate 76 through the two circular slots 86 in the second plate 78 and inserting the pivot pin 85 through the pivot hole 80 in the first plate 76 and through the center pivot hole 84 in the second plate 78. A nut is threaded onto the pivot pin 85 to hold the two plates together and the shoulder of the shoulder bolt ensures a slight clearance between the plates is maintained after the nut is tightened. Nuts and washers are screwed onto the ends of the two index pins 87 extending through the two circular slots 86. In this embodiment, the location of the two threaded stop holes 82, the diameter of the two index pins 87, and the arc length of the two circular slots 86 are sized to provide a hard stop at the end of each circular slot such that the second plate 78 stops at either +22.5 degrees or at −22.5 degrees relative to the longitudinal axis 66 when rotated fully in each direction.

A locking mechanism 68 is provided to lock the infeed slide 58 at either +22.5 degrees, 0 degrees, or −22.5 degrees relative to the longitudinal axis 66. Suitable locking mechanisms can include pins, cams, or brakes. In one embodiment, the locking mechanism 68 comprised two locking nuts and washers threaded onto the two index pins 87. When the nuts are tightened, the washers bear against the surface of the second plate 78 preventing relative motion between the first plate 76 and the second plate 78 until the locking nuts are loosened.

In one embodiment, a center index position is provided such that the infeed slide swivel 60 can be quickly brought back to a position of 0 degrees relative to the longitudinal axis 66. The center index position can be provided by a locating detent on one of the plates and a spring loaded ball assembly on the opposing plate. As the relative position of the two plates approach zero degrees, the spring snaps the ball into the locating detent indicating a zero degree position. Optionally, a locking block can be attached to one of the plates with fasteners to frictionally lock the swivel into the zero position by preventing further rotation after the ball snaps into the detent. Alternatively, a precision rod can replace the spring loaded ball and a precision bore can replace the detent to positively lock the swivel into the zero position by sliding the rod into the bore.

The infeed slide 58 is attached to the infeed slide swivel 60 such that the infeed slide 58 operates parallel to the longitudinal axis 66 in the direction of arrow 90 when the infeed swivel is set at 0 degrees relative to the longitudinal axis 66 (FIG. 3A). The infeed slide 58 is used to advance the truing wheel 40 into the abrasive wheel 26 and establishes the depth of cut removed from the abrasive wheel 26. The infeed slide 58 is operated using a hand wheel, although a motorized slide could be used instead. In one embodiment, an infeed slide 58 part number DS4 from SetCo, Cincinnati, Ohio was used. The infeed slide 58 provided 1.75 inches (44 mm) of travel.

An upper slide block 70 of the infeed slide 58 is attached to the reciprocation slide 54 such that the reciprocation slide 54 moves back and forth at an angle of 90 degrees relative to the motion of the infeed slide 58. The reciprocation slide riser block 56 is located between the infeed slide 58 and the reciprocation slide 54 to provide sufficient clearance to ensure each slide is free to operate without interference and to make it easier to attach the two slides to each other. Depending on the exact slides utilized, the reciprocation slide riser block 56 can be eliminated and the reciprocation slide 54 can be bolted directly to the infeed slide 58.

The reciprocation slide 54 reciprocates the truing wheel 40 back and forth in the direction of arrow 92 a predetermined distance relative to the abrasive wheel 26. As the infeed slide 58 is advanced to remove more material from the abrasive wheel 26, the reciprocation slide 54 moves the truing wheel 40 fully across the entire surface of the abrasive wheel 26 being ground. In one embodiment, the reciprocation slide 54 is driven by pneumatics and adjustable stops are provided that determine the stroke or distance reciprocated by the reciprocation slide 54. In one embodiment, a reciprocation slide 54 part number RZP-12 made by Cleveland Slide of Germany was used. The reciprocation slide 54 provided 4 inches (102 mm) of travel.

The truing wheel spindle housing 46 is attached to the reciprocation slide 54 by the truing wheel swivel 50 such that the truing wheel 40 pivots ±22.5 degrees relative to the longitudinal axis 66 when the infeed slide swivel 60 is set at 0 degrees relative to the longitudinal axis 66. The truing wheel spindle 44 is supported for rotation by the use of bearings or journals within the truing wheel spindle housing 46. The truing wheel spindle 44 is driven by the truing wheel drive 48 such as a motor attached to the fourth plate 96 that transfers power via a timing belt and a first toothed pulley attached to the motor shaft and a second toothed pulley attached to the truing wheel spindle 44.

The truing wheel swivel 50 is designed to allow the truing wheel spindle 44 to rotate ±67.5 degrees relative to the longitudinal axis 66 when the infeed slide swivel 60 is set at 0 degrees relative to the longitudinal axis 66. Suitable swivels can include a cylindrical rod in a support structure, a sphere that rotates within a support structure, a cylindrical rod supported within a hollow rod, or two plates that rotate relative to each other.

In one embodiment, the truing wheel swivel 50 comprised a third plate 94 and a fourth plate 96, which rotate relative to each other. The third plate 94 comprised the upper surface of the truing wheel riser block 52. The truing wheel riser block 52 provides clearance between the truing wheel 40 and the reciprocation slide 54. The third plate 94 includes a threaded pivot hole 81 and two stop holes 100 for locating two index bolts 102. The fourth plate 96 includes a pivot hole 80 and two circular slots 86 having a clearance channel for a bolt head that traps the bolt head to prevent rotation of the bolt.

The truing wheel riser block 52 and the fourth plate 96 assembled by passing the two index bolts 102 through the two circular slots 86 in the fourth plate 96 and inserting the pivot pin 85, such as a shoulder bolt, through the pivot hole 80 in the fourth plate 96 into the threaded pivot hole 81 in the third plate 94. The shoulder of the shoulder bolt ensures a slight clearance between the plates is maintained after the shoulder bolt is tightened in the threaded pivot hole 81. Nuts and washers are screwed onto the ends of the two index bolts 102 extending through the two stop holes 100. In this embodiment, the location of the two stop holes 100, the diameter of the two index bolts 102, and the arc length of the two circular slots 86 are sized to provide a hard stop at the end of each circular slot such that the fourth plate 96 stops at either +22.5 degrees or at −22.5 degrees relative to the longitudinal axis 66 when rotated fully in each direction.

A locking mechanism 68 is provided to lock the truing wheel swivel 50 at either +22.5 degrees, 0 degrees, or −22.5 degrees relative to the longitudinal axis 66. Suitable locking mechanisms can include pins, cams, or brakes. In one embodiment, the locking mechanism 68 comprised two locking nuts and washers threaded onto the two index bolts 102. When the nuts are tightened, the washers bear against the surface of the third plate 94 preventing relative motion between the third plate 94 and the fourth plate 96 until the locking nuts are loosened.

In one embodiment, a center index position is provided such that the truing wheel swivel 50 can be quickly brought back to a position of 0 degrees relative to the longitudinal axis 66. The center index position can be provided by a locating detent on one of the plates and a spring loaded ball assembly on the opposing plate. As the relative position of the two plates approach zero degrees, the spring snaps the ball into the locating detent indicating a zero degree position. Optionally, a locking block can be attached to one of the plates with fasteners to frictionally lock the swivel into the zero position by preventing further rotation after the ball snaps into the detent. Alternatively, a precision rod can replace the spring loaded ball and a precision bore can replace the detent to positively lock the swivel into the zero position by sliding the rod into the bore.

Referring now to FIG. 3A, the truing wheel assembly 42 is positioned to dress the face of the abrasive wheel 26. In this position, the infeed slide swivel 60 and the truing wheel swivel 50 are set at 0 degrees relative to the longitudinal axis 66. This positions the truing wheel spindle 44 at 90 degrees relative to the longitudinal axis 66 and parallel to the abrasive wheel spindle 36 when the bottom support swivel plate 61 is positioned at 0 degrees relative to the Y-axis. The reciprocation slide 54 moves the truing wheel 40 back and forth at an angle of 90 degrees relative to the longitudinal axis 66. In this position, the truing wheel spindle 44 is parallel to the abrasive wheel spindle 36 to machine a flat face profile on the abrasive wheel 26. Alternatively, the bottom support swivel plate 61 can be unlocked and rotated to machine a radius on the abrasive wheel 26 face.

Referring now to FIG. 3B, the truing wheel assembly 42 is positioned to dress a first side 72 of the abrasive wheel 26 in an abrasive wheel pack. In this position, the infeed slide swivel 60 has been set to −22.5 degrees (counter clockwise rotation) and the truing wheel swivel 50 has been set to +22.5 degrees (clockwise rotation) relative to the longitudinal axis 66. This positions the truing wheel spindle 44 at 90 degrees relative to the longitudinal axis 66. The reciprocation slide 54 moves the truing wheel 40 back and forth at an angle of −67.5 degrees (counter clockwise rotation of the reciprocation slide) relative to the longitudinal axis 66. The bottom swivel plate has been rotated to −67.5 degrees (counter clockwise rotation) relative to the Y axis 33. Rotation of the three swivels the specified number of degrees results in reciprocating the reciprocation slide 54 parallel to the Y axis 33. By using two swivels (infeed slide swivel 60 and truing wheel swivel 50) and rotating each 22.5 degrees improved access to the first side 72 of the abrasive wheel 26 occurs and the reciprocation of the truing wheel 40 is parallel to the Y axis 33 to side dress the first side 72 when the bottom support swivel plate 61 is rotated −67.5 degrees. Furthermore, less rotation of the infeed slide 58 occurs, thereby minimizing interference of the infeed slide 58 with other portions of the truing and dressing machine 20 such as the X-Y compound slide 24.

Referring now to FIG. 3C, the truing wheel assembly 42 is positioned to dress a second side 74 of the abrasive wheel 26 in an abrasive wheel pack. In this position, the infeed slide swivel 60 has been set to +22.5 degrees (clockwise rotation) and the truing wheel swivel 50 has been set to −22.5 degrees (counter clockwise rotation) relative to the longitudinal axis 66. This positions the truing wheel spindle 44 at 90 degrees relative to the longitudinal axis 66. The reciprocation slide 54 moves the truing wheel 40 back and forth at an angle of +67.5 degrees (clockwise rotation of the reciprocation slide) relative to the longitudinal axis 66. The bottom swivel plate has been rotated to +67.5 degrees (clockwise rotation) relative to the Y axis 33. Rotation of the three swivels the specified number of degrees results in reciprocating the reciprocation slide 54 parallel to the Y axis 33. By using two swivels (infeed slide swivel 60 and truing wheel swivel 50) and rotating each 22.5 degrees improved access to the second side 74 of the abrasive wheel 26 occurs and the reciprocation of the truing wheel 40 is parallel to the Y axis 33 to side dress the second side 74 when the bottom support swivel plate 61 is rotated +67.5 degrees. Furthermore, less rotation of the infeed slide 58 occurs, thereby minimizing interference of the infeed slide 58 with other portions of the truing and dressing machine 20 such as the X-Y compound slide 24.

Referring back to FIG. 1, in one embodiment, the truing and dressing machine 20 included a camera 104 and a video monitor 106 with different magnification levels to view the profile created on the abrasive wheel 26. The video monitor 106 can also display the X-Y position of the abrasive wheel 26 and the angular rotation of the bottom support swivel plate 61 when an angle transducer is attached to the hollow shaft 112. In another embodiment, the abrasive wheel drive 38 was variable speed and reversible. In another embodiment, the truing wheel drive 48 was variable speed. In another embodiment, a dust extraction system was included to reduce airborne dust created during the dressing operation by removing grinding dust through the hollow shaft 112 on which the truing wheel assembly 42 pivots.

Suitable truing wheels for use with the truing and dressing machine 20 include abrasive wheels comprising silicon carbide or aluminum oxide available from 3M. In one embodiment, the truing wheel 40 comprised a silicon carbide wheel part number GENF 2679 available from 3M Abrasive Systems Division, Whippany, N.J. was used. The abrasive wheel 26 being dressed typically comprises diamond or cubic boron nitrate abrasive. Abrasive wheels for grinding machined parts that are dressed by the truing and dressing machine 20 are available from 3M. Typical diameters of the abrasive wheel 26 to be dressed are 0.0625 inch to 14 inches (1.59 mm to 355 mm).

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in a consistent manner. In the event of inconsistencies or contradictions between the incorporated references and this application, the information in the preceding description shall control. The preceding description in order to enable one of ordinary skill in the art to practice the claimed invention is not to be construed as limiting the scope of the invention, which is defined by the claims and all equivalents thereto.

What is claimed is:

1. A truing and dressing machine comprising:

a base plate having an X axis and a Y axis passing through a primary pivot;

an abrasive wheel spindle supported for rotation in an abrasive wheel spindle housing, the abrasive wheel spindle housing attached to the base plate, and the abrasive wheel spindle operably connected to an abrasive wheel drive for rotation;

a truing wheel assembly rotatably connected to the base plate for rotation about the primary pivot located in the base plate;

the truing wheel assembly including a bottom support swivel plate, an infeed slide swivel attached to the bottom support swivel plate, an infeed slide attached to the infeed slide swivel, a reciprocation slide attached to the infeed slide, a truing wheel swivel attached to the infeed slide, a truing wheel spindle housing attached to the truing wheel swivel, a truing wheel spindle supported for rotation in the truing wheel spindle housing, and the truing wheel spindle operably connected to a truing wheel drive for rotation.

2. The truing and dressing machine of claim 1 wherein the infeed slide swivel rotates ±22.5 degrees.

3. The truing and dressing machine of claim 2 wherein the truing wheel swivel rotates ±22.5 degrees.

4. The truing and dressing machine of claim 1 wherein the truing wheel swivel rotates ±22.5 degrees.

5. The truing and dressing machine of claim 1 wherein the bottom support swivel plate comprises a circular portion surrounding the primary pivot and an offset arm extending from the circular portion, the offset arm having a longitudinal axis, and the infeed slide swivel is attached to the offset arm.

6. The truing and dressing machine of claim 5 wherein the infeed slide swivel rotates ±22.5 degrees relative to the longitudinal axis.

7. The truing and dressing machine of claim 5 wherein the truing wheel swivel rotates ±22.5 degrees relative to the longitudinal axis.

8. The truing and dressing machine of claim 6 wherein the truing wheel swivel rotates ±22.5 degrees relative to the longitudinal axis.

9. The truing and dressing machine of claim 8 wherein the abrasive wheel spindle housing is attached to an X-Y compound slide and the X-Y compound slide is attached to the base plate to move the abrasive wheel spindle parallel to the X axis and parallel to the Y axis.

10. The truing and dressing machine of claim 9 wherein the infeed slide and the reciprocation slide are attached to each other at a 90 degree angle.

11. The truing and dressing machine of claim 10 wherein the reciprocation slide reciprocates the truing wheel spindle at an angle of −67.5 degrees relative to the longitudinal axis when the infeed slide swivel is set at −22.5 degrees relative to the longitudinal axis and the reciprocation slide reciprocates the truing wheel spindle parallel to the Y axis when the truing wheel swivel is set at +22.5 degrees relative to the longitudinal axis and the bottom support swivel plate is set at −67.5 degrees relative to the Y axis.

12. The truing and dressing machine of claim 10 wherein the reciprocation slide reciprocates the truing wheel spindle at an angle of +67.5 degrees relative to the longitudinal axis when the infeed slide swivel is set at +22.5 degrees relative to the longitudinal axis and the reciprocation slide reciprocates the truing wheel spindle parallel to the Y axis when the truing wheel swivel is set at −22.5 degrees relative to the longitudinal axis and the bottom support swivel plate is set at +67.5 degrees relative to the Y axis.

13. The truing and dressing machine of claim 10 wherein the reciprocation slide reciprocates the truing wheel spindle at an angle of 90 degrees relative to the longitudinal axis when the infeed slide swivel is set at 0 degrees relative to the longitudinal axis and the truing wheel swivel is set at 0 degrees relative to the longitudinal axis.

14. The truing and dressing machine of claim 1 wherein the infeed slide swivel comprises a first plate and a second plate that rotate relative to each other.

15. The truing and dressing machine of claim 14 wherein the truing wheel swivel comprises a third plate and a fourth plate that rotate relative to each other.

16. The truing and dressing machine of claim 1 wherein the truing wheel swivel comprises two plates that rotate relative to each other.

17. The truing and dressing machine of claim 5 wherein the infeed slide swivel comprises a first plate and a second plate that rotate relative to each other and the first plate comprises a distal end of the offset arm.

18. The truing and dressing machine of claim 17 wherein the truing wheel swivel comprises a third plate and a fourth plate that rotate relative to each other.

19. The truing and dressing machine of claim 5 wherein the truing wheel swivel comprises two plates that rotate relative to each other.

* * * * *

UNITED STATES PATENT AND TRADEMARK OFFICE

CERTIFICATE OF CORRECTION

PATENT NO. : 8,590,523 B2
APPLICATION NO. : 12/993234
DATED : November 26, 2013
INVENTOR(S) : Keith Lee O'Malley It is certified that error appears in the above-identified patent and that said Letters Patent is hereby corrected as shown below:

On the Title Page, in Column 1, after "(65) Prior Publication Data US2011/0067683 A1 March 24, 2011"
Insert the following:

-- Related U.S. Application Data

(60) Provisional application No. 61/089,377, filed on August 15, 2008. --

Signed and Sealed this
Twenty-fourth Day of June, 2014

Michelle K. Lee

Michelle K. Lee
*Deputy Director of the United States Patent and Trademark Office*